US009586099B2

(12) United States Patent
Holthouse

(10) Patent No.: US 9,586,099 B2
(45) Date of Patent: Mar. 7, 2017

(54) TRACKING BALLS IN SPORTS

(71) Applicant: Catapult Group International PTY Ltd, Docklands (AU)

(72) Inventor: Shaun Holthouse, Docklands (AU)

(73) Assignee: Catapult Group International PTY Ltd (AU)

( * ) Notice: Subject to any disclaimer, the term of this patent is extended or adjusted under 35 U.S.C. 154(b) by 0 days.

(21) Appl. No.: 14/413,128

(22) PCT Filed: Jul. 8, 2013

(86) PCT No.: PCT/AU2013/000739
§ 371 (c)(1),
(2) Date: Jan. 6, 2015

(87) PCT Pub. No.: WO2014/008530
PCT Pub. Date: Jan. 16, 2014

(65) Prior Publication Data

US 2015/0157900 A1 Jun. 11, 2015

(30) Foreign Application Priority Data

Jul. 9, 2012 (AU) ..... 2012902900

(51) Int. Cl.
*A63B 43/00* (2006.01)
*A63B 24/00* (2006.01)
(Continued)

(52) U.S. Cl.
CPC ..... *A63B 43/004* (2013.01); *A63B 24/0021* (2013.01); *A63B 41/00* (2013.01);
(Continued)

(58) Field of Classification Search
CPC ..... A63B 41/00; A63B 41/04; A63B 43/004; A63B 24/0021; A63B 2024/0025;
(Continued)

(56) References Cited

U.S. PATENT DOCUMENTS 1,990,374 A * 2/1935 Goldsmith ..... F16K 15/202 137/223
4,577,865 A * 3/1986 Shishido ..... A63B 43/00 473/446
(Continued)

FOREIGN PATENT DOCUMENTS

AU 2006222732 10/2006
AU 2008205421 3/2009
(Continued)

OTHER PUBLICATIONS

Corresponding International Search Report PCT/AU2013/000739 dated Sep. 6, 2013.

*Primary Examiner* — Steven Wong
(74) *Attorney, Agent, or Firm* — The Belles Group, P.C.

(57) ABSTRACT

An electronically trackable ball consisting of a cover, an inflatable bladder, a valve in the bladder a mounting structure attached to said valve and extending inwardly of the valve toward the center of the inflated bladder and an electronic transmission device on said mounting structure remote from said valve. The mounting structure is preferably a lightweight polymeric cylinder with the electronics fitted at the end remote from the valve and close to the center of mass of the ball. The device is within the ball, and is constrained from moving around inside the ball.

12 Claims, 3 Drawing Sheets

(51) Int. Cl.
*A63B 41/00* (2006.01)
*A63B 41/04* (2006.01)

(52) U.S. Cl.
CPC ..... *A63B 41/04* (2013.01); *A63B 2024/0025* (2013.01); *A63B 2024/0056* (2013.01); *A63B 2220/12* (2013.01); *A63B 2220/13* (2013.01); *A63B 2220/836* (2013.01); *A63B 2225/50* (2013.01); *A63B 2225/54* (2013.01); *A63B 2243/007* (2013.01); *A63B 2243/0025* (2013.01)

(58) Field of Classification Search
CPC ..... A63B 2024/0056; A63B 222/12; A63B 2220/13; A63B 2220/836; A63B 2225/54; A63B 2225/50; A63B 2243/0025; A63B 2243/007
See application file for complete search history.

(56) References Cited

U.S. PATENT DOCUMENTS 4,595,200 A * 6/1986 Shishido ..... A63B 43/00 473/570
5,976,038 A 11/1999 Orenstein et al.
6,935,977 B2 * 8/2005 Kennedy, II ..... A63B 41/10 473/593
7,517,294 B2 * 4/2009 Tsai ..... A63B 41/02 473/594
7,740,551 B2 6/2010 Nurnberg et al.
8,292,764 B2 * 10/2012 Steidle ..... A63B 41/085 473/610
8,517,870 B2 * 8/2013 Crowley ..... A63B 41/00 473/570
8,540,595 B1 * 9/2013 Lin ..... A63B 41/02 473/610
8,771,110 B2 * 7/2014 Steidle ..... A63B 41/085 473/570
2003/0224885 A1 * 12/2003 Leal ..... A63B 43/06 473/570
2006/0135297 A1 6/2006 Cruciani
2009/0048044 A1 2/2009 Oleson et al.
2010/0130314 A1 * 5/2010 Von Der Gruen ..... A63B 63/00 473/570
2010/0130315 A1 5/2010 Steidle
2010/0130316 A1 * 5/2010 Steidle ..... A63B 41/085 473/593
2010/0167851 A1 * 7/2010 Burke ..... A63B 41/00 473/610
2012/0058845 A1 3/2012 Crowley et al.

FOREIGN PATENT DOCUMENTS

WO 2005044396 5/2005
WO 2011109553 5/2011

* cited by examiner

TRACKING BALLS IN SPORTS

PRIORITY

Priority is claimed as a national stage application, under 35 U.S.C. §371, to international application No. PCT/AU2013/00739, filed Jul. 8, 2013, which claims priority to French application AU2012902900, filed Jul. 9, 2012. The disclosures of the aforementioned priority applications are incorporated herein by reference in their entirety.

This invention relates to improvements in the method of tracking balls in sports particularly the various codes of football using oval balls and the various team sports using round balls such as soccer basketball and netball. In particular it relates to e method of mounting electronic components inside the ball without affecting the performance or perceived behaviour of the ball

BACKGROUND TO THE INVENTION

The idea of using locating beacons in balls has been proposed.

U.S. Pat. No. 5,976,038 discloses a football with a transmitter at each end transmitting different frequencies. These are detected by antennas off the field of play to detect line crossing as in out of bounds or a score.

WO2005/044396 discloses a construction where the electronic components are held in the centre of the ball between two or more bladder portions that fill the interior of the ball.

USA 2006/0135297 Discloses a number of arrangements most of which locate the sensors adjacent the bladder wall or outer covering of the ball. One proposal is to suspend the sensors within the ball.

WO 2011/1095353 also discloses locating the sensors adjacent the bladder wall or outer covering of the ball.

Australian patent 2008205421 discloses a ball tracking system in which a ball incorporates a short range beacon and players wear data loggers that record the ball beacon signal when received indicating that the ball is being contested or possessed by the player. This system is less expensive than other systems and enables an in expensive beacon to be used in the ball so that frequent replacement is not an issue.

U.S. Pat. No. 7,740,551 discloses a number of arrangements for suspending the electronics within the ball. These include mounting feet on the bladder wall.

USA 20100130315 discloses a a ball with two diametrically opposed electronic devices on the bladder wall with connecting wiring on the bladder wall. One of the devices is one or more LED's and the other is a pressure sensor and battery. One of the devices is mounted around the valve of the bladder.

USA 20120058845 discloses a ball construction where the electronic unit is located in a compartment separated from the pressurised interior of the ball. The compartment is located opposite the valve for the bladder.

It is an object of this invention to provide an inexpensive means of locating a an electronic transmitter in a ball for use in the system disclosed in Australian patent 2008205421.

BRIEF DESCRIPTION OF THE INVENTION

To this end the present invention provides a ball consisting of a cover, an inflatable bladder, a valve in the bladder a mounting structure attached to said valve and extending inwardly of the valve toward the centre of the inflated bladder and an electronic transmission device on said mounting structure remote from said valve.

This arrangement enables a low cost trackable ball to be produced in accordance with the ball tracking system disclosed in Australian patent 2008205421.

Players will be reluctant to use balls where they can feel the device inside or it affects the normal weight feel and behaviour of the ball.

The mounting structure is preferably a lightweight polymeric cylinder with the electronics preferably fitted at the end remote from the valve and close to the centre of mass of the ball. The device is within the ball, and is constrained from moving around inside the ball. The transmitter device is protected from impacts due to the rigors of play and practise associated with sports because it is within the interior of the bladder. The balance of the ball is not affected by mounting the device according to this invention and it does not affect the behaviour of the ball during play. The weight of the device is minimal, so that play is not affected.

Preferably the data logger worn by the players also includes location and speed sensors, which enable the micro controller to track the path of the ball from player to player relative to the playing field. A suitable data logger is disclosed in Australian patent 2006222732 which discloses a data logger that can track the movement of a player on a playing field.

Preferably the signals are transmitted at a frequency which is not attenuated by the body of the players. Preferably a wireless beacon pulsing in the 5-10 Hz range may be used.

These signals are picked up by a data logger worn by the players and used to indicate that the player is either in possession of the ball (short range beacon) or contesting possession (longer range beacon).

Instead of tracking the ball directly this system tracks the ball relative to the players and records and tracks possession from player to player. Currently available technology such as GPS (or wireless triangulation) provides the position of the players on the field and allows the player's movements during the game to be tracked. This invention adds information about which player is in proximity to the ball and has had impact with it (for instance a kick) and this enables a computer simulation of the path of the ball during play.

This is an inexpensive alternative to the extremely cumbersome methods, currently available for direct ball tracking.

The beacons may be powered by a battery or a piezo energy harvester mounted on the football cover which produces current from impacts to power the electronics.

The battery may be rechargeable by inductive charging between uses by incorporating a charging coil which wraps around the valve assembly close to the internal wall of the ball.

DETAILED DESCRIPTION OF THE INVENTION

A preferred embodiment of the invention will now be described with reference to the drawings in which.

Figure 1:
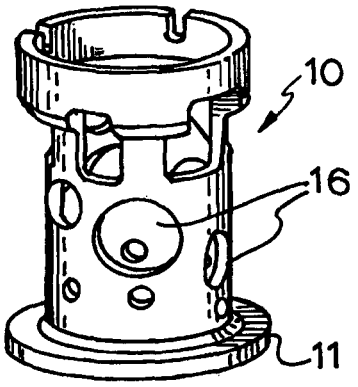
FIG. 1 illustrates a mounting cylinder of the present invention.
Figure 2:
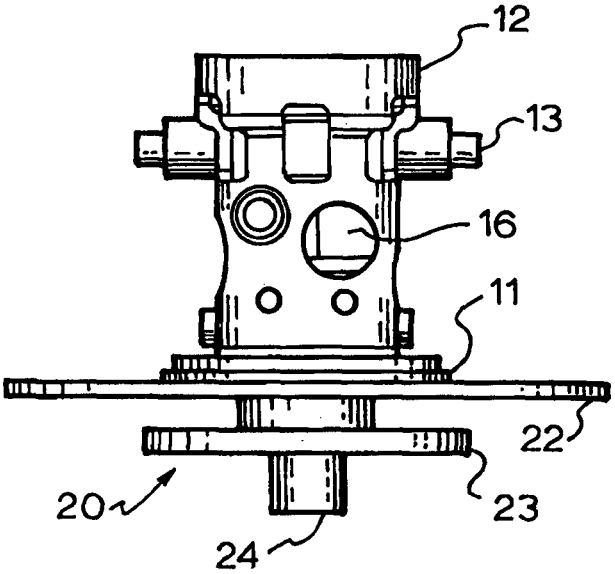
FIG. 2 illustrates the cylinder of FIG. 1 bonded to a valve assembly
Figure 3:
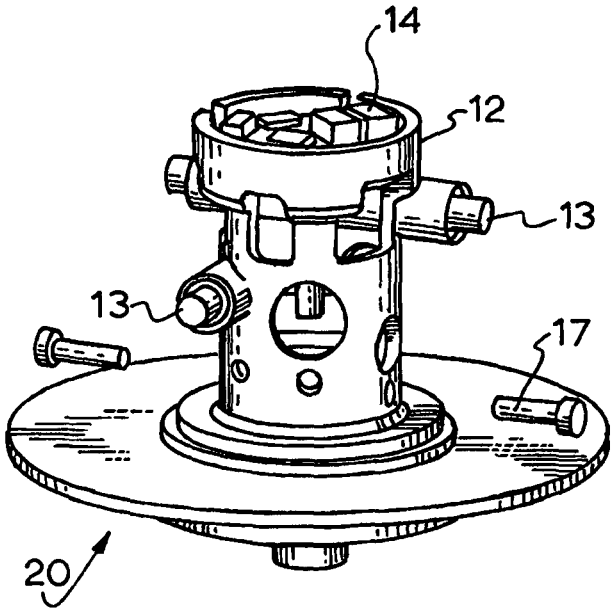
FIGS. 3 and 4 illustrate the attachment of the cylinder to the valve assembly.
Figure 4:
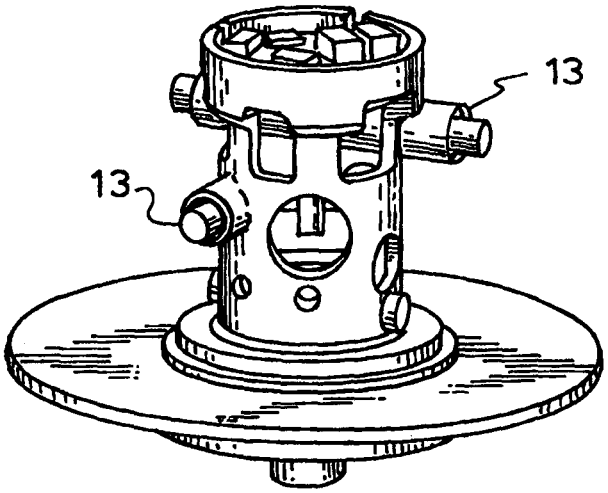
Figure 5:
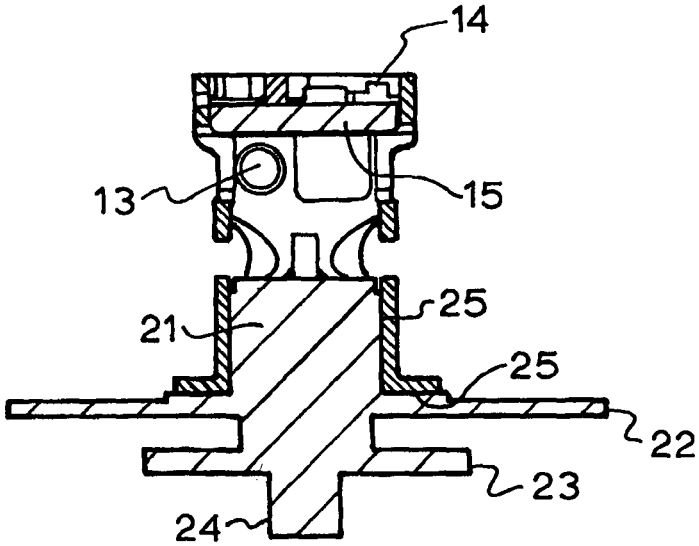
FIG. 5 is a cross sectional view of the assembled unit prior to fitting to a ball bladder.
Figure 6:
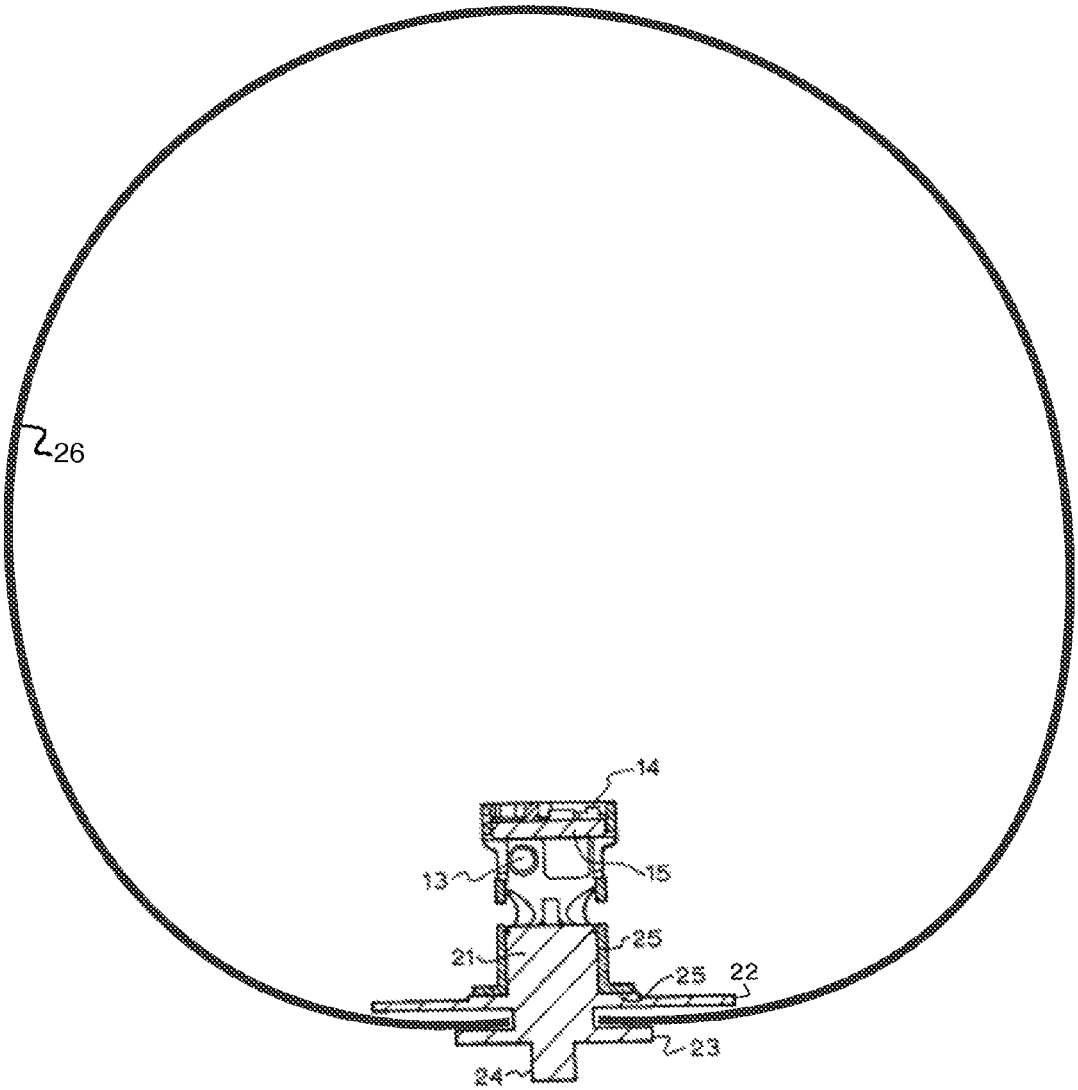
FIG. 6 is a cross sectional view of the assembled unit fitted to a ball bladder.

The ball and tracking system is as disclosed in Australian patent 2008205421 and is used with a data logger as disclosed in Australian patent 2006222732.

The mounting piece 10 is perforated with openings 16 to reduce the amount of weight added to the ball and further help move the centre of mass of the ball tracking assembly towards the original centre of mass of the ball. The perforations 16 also allow the compressed air to enter the main bladder 26 during inflation. The mounting piece 10 is made of tough polymer that damps impact and vibration and is not susceptible to brittle or fatigue failure.

The mounting piece 10 is fixed to the valve assembly 20 on the inside of the bladder 26. It may be fixed by glue 25 and or screws 17. The valve assembly consists of the valve body 21 an inside flange 22, an outside flange 23 and an inflation inlet 24. The flange 11 at the base of the mounting device 10 may be glued to the inside flange 22 of the valve assembly at glue areas 25. The wall of the bladder 26 is adhered to the valve assembly 20 between the inside flange 22 and the outside flange 23 of the valve assembly. The electronic components and circuit board 14 and the battery 15 of the tracking device are mounted within the compartment 12 at the inner end of the mounting device 10. Two antennae 13 are connected electrically to the electronics 14 and fitted to the mounting cylinder 10. The antenna may be any conventional arrangement and may extend around compartment 12 or flange 11. Since the valve assembly 20 is typically very compliant (eg. Rubber or latex) the flange 11 of the mounting device prevents the assembly 10 from pivoting around the valve assembly 20 and impacting the side wall of the ball during impact.

The flange 11 is not very large in diameter however so that players cannot feel a stiffer section of the surface around the valve body 21.

Since all the ball tracking electronics 14 and power supply 15 and antenna 13 are mounted in or adjacent the compartment 12 at the end of the mounting piece 10, the centre of mass of the ball tracking module is moved away from the side wall of the ball towards the centre of mass of the ball. This means minimum impact on the balls balance (and consequent flight, bounce etc.)

By fixing the mounting piece to the external wall, the potential for it to move around inside the ball is greatly reduced. The device is not affected when the ball is impacted.

Most ball manufacturers make the bladders in 2 parts: the main bladder and the valve assembly. The main bladder has a hole in it and the valve assembly 20 is then glued or otherwise bonded in. This means that the assembly process for the tracking module of this invention can fit neatly into the existing assembly processes. The module 10 can be first assembled to the valve assembly 20, and then the valve assembly can be glued or bonded to the main bladder as per normal balls.

Alternative methods of mounting electronics in balls seem to have much more complicated structures that are difficult and expensive to manufacture.

Since the electronics used in the ball are low powered, the battery will last longer than the ball. The electronics are also inexpensive so that the cost of the instrumented balls is only a small increment above normal ball cost. If desired a switch on/off functionality via a reed switch in the electronics may be provided but it is preferred to use impact sensors to automatically switch on the beacon. Inductive charging may be used to recharge the battery before use. The battery 15 may be connected to a charging coil wound around the base of the valve assembly 21 close to the internal wall of the ball.

Those skilled in the art will realise that this invention provides a unique system that is able to be used in a range of sports to track the movement of the ball relative to one or more players. Those skilled in the art will also realise that this invention can be implemented in embodiments other than those described without departing from the core teachings of the invention.

The invention claimed is:

1. An electronically trackable ball comprising:

an inflatable bladder, a valve in the bladder, a mounting structure comprising a first end attached to said valve, a second end, and a mounting surface located at the second end, the mounting structure extending inwardly of the valve toward the centre of the inflated bladder such that the mounting surface is closer to the center of mass of the ball than the valve, and an electronic transmission device on said mounting surface, wherein the mounting structure comprises a wall extending between the first end and the second end, the wall forming an open center portion into which the valve extends and including a plurality of perforations for compressed air to pass from the valve within the open center portion and into the bladder during inflation.

2. The electronically trackable ball as claimed in claim 1 in which the electronic transmission device includes a power source, and electronic transmission circuit and an antenna.

3. The electronically trackable ball as claimed in claim 1 further comprising a battery which is rechargeable by inductive charging.

4. The electronically trackable ball as claimed in claim 1 in which the mounting structure is a cylinder with a rigid flange around one end so that the flange is attached to the bladder wall around the valve.

5. A system for tracking a ball as claimed in claim 1 in which a data logger worn by the player receives signals from the electronics device in the ball when the player is contesting the ball or in possession of the ball.

6. The system as claimed in claim 5 which includes location sensors in the data logger for tracking the movements of the players on the playing field.

7. An electronically trackable ball comprising:

an inflatable bladder, a valve in the bladder, a mounting structure comprising a first end attached to said valve, a second end, and a mounting surface located at the second end, the mounting structure extending inwardly of the valve toward the centre of the inflated bladder such that the mounting surface is closer to the center of mass of the ball than the valve, and an electronic transmission device on said mounting surface, wherein:

the valve comprises a valve body, an inside flange, and an outside flange, with a wall of the bladder seated adhered between the inside flange and the outside flange; and the mounting structure comprises a wall and a support flange, wherein the support flange is located at the first end of the mounting structure extending outward from the wall and abuts against the inside flange of the valve.

8. The electronically trackable ball as claimed in claim 7, wherein the support flange of the mounting structure is adhered to the inside flange of the valve.

9. The electronically trackable ball as claimed in claim 7 in which the electronic transmission device includes a power source, and electronic transmission circuit and an antenna.

10. The electronically trackable ball as claimed in claim 7 further comprising a battery which is rechargeable by inductive charging.

11. A system for tracking a ball as claimed in claim 7 in which a data logger worn by the player receives signals from the electronics device in the ball when the player is contesting the ball or in possession of the ball.

12. The system as claimed in claim 11 which includes location sensors in the data logger for tracking the movements of the players on the playing field.

* * * * *